US010157556B2

(12) United States Patent
Allen

(10) Patent No.: US 10,157,556 B2
(45) Date of Patent: Dec. 18, 2018

(54) FLAG AND BANNER DISPLAY SYSTEM FOR MOTOR VEHICLES AND THE LIKE

(71) Applicant: Cory Allen, Boynton Beach, FL (US)

(72) Inventor: Cory Allen, Boynton Beach, FL (US)

( * ) Notice: Subject to any disclaimer, the term of this patent is extended or adjusted under 35 U.S.C. 154(b) by 0 days.

(21) Appl. No.: 15/597,293

(22) Filed: May 17, 2017

(65) Prior Publication Data

US 2017/0256184 A1 Sep. 7, 2017

Related U.S. Application Data

(63) Continuation of application No. 14/500,527, filed on Sep. 29, 2014, now Pat. No. 9,672,761.

(60) Provisional application No. 61/883,353, filed on Sep. 27, 2013.

(51) Int. Cl.
*G09F 17/00* (2006.01)

(52) U.S. Cl.
CPC ..... *G09F 17/00* (2013.01); *G09F 2017/005* (2013.01); *G09F 2017/0075* (2013.01)

(58) Field of Classification Search
CPC ..... A63B 57/357; B60Q 7/005; B60Q 7/02; G09F 17/00; G09F 2017/005; G09F 2017/0058; G09F 2017/0075; G09F 21/00; G09F 21/04; G09F 21/048
USPC ..... 116/28 R, 30, 173, 174, 175; 40/591, 40/592; 446/248; 473/176, 586, 588, 473/589, 590
See application file for complete search history.

(56) References Cited

U.S. PATENT DOCUMENTS

| | | | | |
|---|---|---|---|---|
| 3,330,247 | A * | 7/1967 | Gunderson | G09F 17/00 116/174 |
| 3,926,139 | A | 12/1975 | Sabin | |
| 4,944,111 | A | 7/1990 | Daniel | |
| 5,383,296 | A | 1/1995 | Vecchione et al. | |
| 5,517,941 | A | 5/1996 | Fisher | |
| 5,615,635 | A | 4/1997 | Deviney | |
| 5,740,622 | A | 4/1998 | Martin | |
| 5,836,059 | A | 11/1998 | Chung | |
| 5,975,390 | A | 11/1999 | Saroli | |
| 7,062,873 | B2 | 6/2006 | Hlavin | |
| 7,424,864 | B2 | 9/2008 | McCann | |
| 7,520,074 | B1 | 4/2009 | Vanova | |
| 7,690,322 | B2 | 4/2010 | Lanh | |
| D624,847 | S | 10/2010 | Czyzewski | |
| 7,810,265 | B2 | 10/2010 | Beatty | |
| 9,087,462 | B1 | 7/2015 | Gallus | |

(Continued)

FOREIGN PATENT DOCUMENTS

KR 1020120102245 A 9/2012

*Primary Examiner* — Richard A. Smith
(74) *Attorney, Agent, or Firm* — Mendelsohn Dunleavy, P.C.; Steve Mendelsohn

(57) ABSTRACT

In one embodiment, a flag system including a mounting sleeve and a flag. The mounting sleeve is adapted for attachment around a rod, such as a roll bar of an open-top off-road vehicle or an antenna. In one embodiment, the flag is adapted to be releasably fastened to the mounting sleeve. The mounting sleeve includes a section of material adapted for attachment around a rod by means of a zipper secured with hook-and-loop fastener, and a zipper for releasably fastening the flag to the mounting sleeve. The flag includes an ornamental portion, a zipper tape, and a transition strip having a first side coupled to the ornamental portion and a second side coupled to the zipper tape.

12 Claims, 12 Drawing Sheets

(56) References Cited

U.S. PATENT DOCUMENTS

| | | | |
|---|---|---|---|
| 2002/0134297 | A1 | 9/2002 | Moye |
| 2008/0108458 | A1 | 5/2008 | Winningham et al. |
| 2009/0146029 | A1 | 6/2009 | Beatty |
| 2011/0278248 | A1 | 11/2011 | Pron |
| 2012/0318189 | A1 | 12/2012 | Oyoung |
| 2014/0221180 | A1 | 8/2014 | Flores |
| 2014/0274434 | A1 | 9/2014 | Barelli |

* cited by examiner

FLAG AND BANNER DISPLAY SYSTEM FOR MOTOR VEHICLES AND THE LIKE

CROSS-REFERENCE TO RELATED APPLICATIONS

This application is a continuation of co-pending U.S. patent application Ser. No. 14/500,527 filed on Sep. 29, 2014 and claims priority to U.S. Provisional Patent Application Ser. No. 61/883,353, filed Sep. 27, 2013, the disclosures of which are incorporated herein by reference in their entirety.

BACKGROUND

The disclosure relates, generally, to ornamental displays, and more particularly, to the display of flags or banners on motor vehicles and elsewhere.

Flags are typically displayed using one of three types of flag pole. A first type of flag pole is moveable, such as a flag pole supported by a weighted base, used during school assemblies. A second type of flag pole is permanently affixed to the ground, such as a conventional flag pole set into concrete outside of a government building. A third type of flag pole is mounted using a bracket, such as may be used to hang a flag from the side of a building.

Attaching a flag to some locations, including motor vehicles, can be desirable but problematic. The display of a national flag attached to a motor vehicle can show the driver's or owner's support, affiliation, or pride. Other flags that drivers seek to display include collegiate and professional sports team flags. Banners displaying custom messages are another type of flag that a driver might wish to exhibit. However, conventional methods of flag and banner display have drawbacks.

For example, although a driver of a motor vehicle desiring to display a flag on his or her motor vehicle may choose to hang a flag in a window (e.g., rear window) of the vehicle, display of a flag in this manner can obstruct the driver's vision. Other vehicle mounts include a fender mount or bumper mount on the rear of a motorcycle, as well as mounts for flags flown from a pole extending out of a "post hole" formed in the rear of a pickup truck bed. However, these arrangements all require driving with a flag pole protruding from the vehicle. Factors such as flag weight, travel speed, and wind and other weather conditions can all contribute to the flag pole breaking, detaching, splintering, deteriorating, or otherwise degrading, resulting in potential personal and property damage.

On "Flag Day," Jun. 14, 1923, the National Flag Code was adopted by the Army and Navy and about 66 other national organizations, in order to provide unified guidance for the display and other handling of the American flag. On Jun. 22, 1942, Congress passed a joint resolution to enact nationwide laws for use and display of the flag, codified at 36 U.S.C. §§ 173-178. These laws include 36 U.S. Code § 175, entitled "Position and manner of display," which prohibits, among other things, the display of a flag over the hood, top, sides, or back of a vehicle, and requires, whenever a flag is displayed on a car, the use of a staff that is either fixed firmly to the chassis or clamped to the right fender.

Notwithstanding these national laws, and despite much interest in flag display among vehicle owners and drivers, no significant innovation has taken place to address the foregoing problems associated with displaying a flag on a motor vehicle.

SUMMARY

Embodiments of the present disclosure provide a system for displaying flags, banners, and the like on motor vehicles, including cars, trucks, and boats. In one embodiment, the system includes a mounting sleeve configured for secure attachment to the vehicle, and a detachable flag adapted to securely attach to the mounting sleeve by means of a zipper. In one embodiment, different flags and/or banners may be quickly and easily interchanged onto the mounting sleeve. In one embodiment, different mounting sleeves may be used for different vehicles and mounting arrangements, e.g., to permit one or more flags or banners to be quickly and easily interchanged among vehicles. Embodiments of the disclosure include mounting sleeves adapted for attachment to various cylindrical or elongated portions of a vehicle, including, e.g., a roll bar of an open-top off-road vehicle, truck, or sport-utility vehicle, a vehicle antenna, or a railing on a boat, train, or bus.

In one embodiment, the present invention provides a flag system including a mounting sleeve and a flag. The mounting sleeve is adapted for attachment around a rod. The flag is adapted to be releasably fastened to the mounting sleeve.

In another embodiment, the present invention provides a mounting sleeve. The mounting sleeve includes: a section of material adapted for attachment around a rod; one or more fastening devices for releasably fastening a flag to the mounting sleeve; and one or more fastening devices adapted to attach the section of material around the rod.

In a further embodiment, the present invention provides a flag. The flag includes an ornamental portion, a zipper tape, and a transition strip. The transition strip has first and second sides. The first side of the transition strip is coupled to the ornamental portion. The second side of the transition strip is coupled to the zipper tape.

DETAILED DESCRIPTION

Detailed illustrative embodiments of the present disclosure are disclosed herein. However, specific structural and functional details disclosed herein are merely representative for purposes of describing example embodiments of the present disclosure. Embodiments of the present disclosure may be embodied in many alternative forms and should not be construed as limited to only the embodiments set forth herein. Further, the terminology used herein is for the purpose of describing particular embodiments only and is not intended to be limiting of example embodiments of the disclosure.

Figure 1:
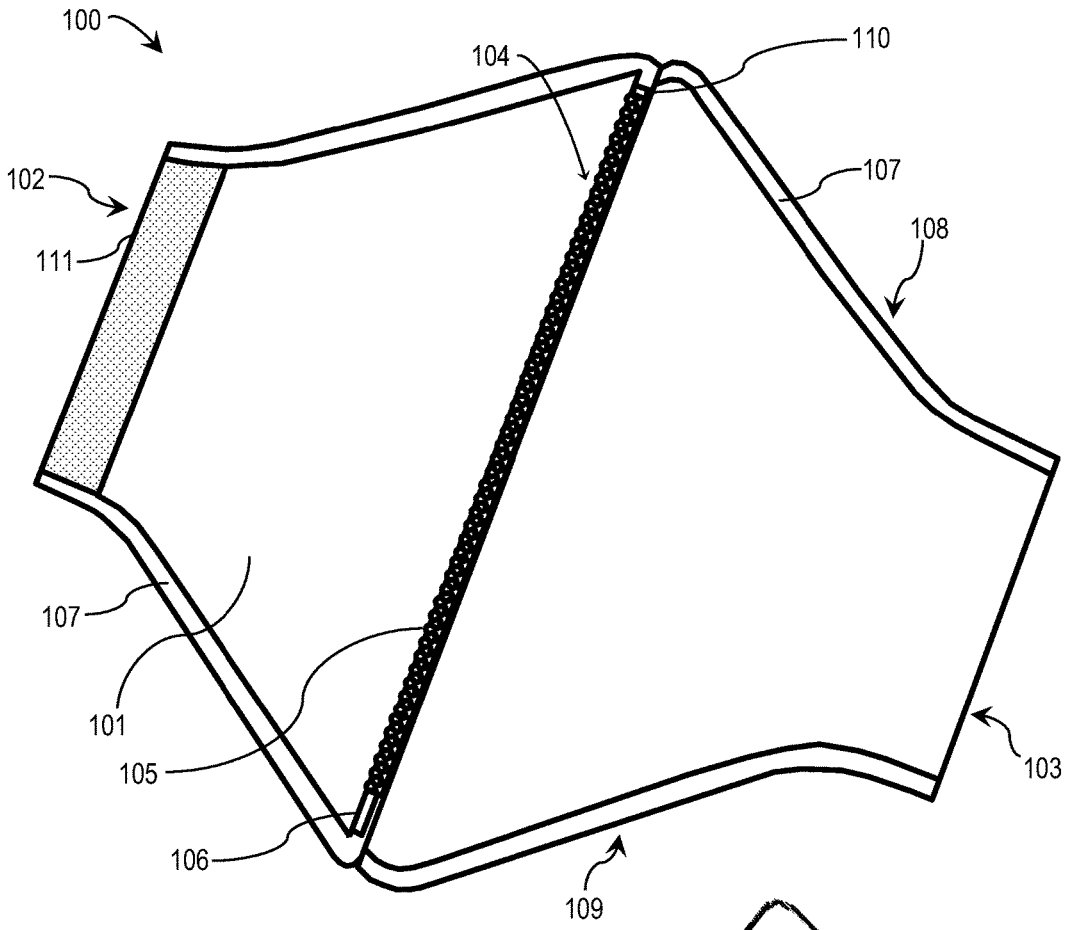
FIG. 1 shows a top plan view of a mounting sleeve consistent with a first exemplary embodiment of the disclosure.

FIG. 1 shows a top plan view of a mounting sleeve 100 consistent with a first exemplary embodiment of the disclosure. In this embodiment, mounting sleeve 100 is intended for installation onto the roll bar of an open-top off-road vehicle, or a railing, or the like. Although mounting sleeve 100 is approximately hexagonal in shape, other mounting sleeve shapes are possible in alternative embodiments, including e.g., square, rectangular, trapezoidal, octagonal, and circular.

As shown, in this embodiment, mounting sleeve 100 includes a fabric wrapper 101 having an inner flap 102 and an outer flap 103. Fabric wrapper 101 is desirably an open-weave, military-grade, outdoor mesh fabric, and may include one or more of polyvinyl chloride (PVC) mesh, a vinyl-coated synthetic fiber (e.g., polyester) mesh having ultraviolet (UV) resistance, another durable and weatherproof material, or the like.

A zipper tape 104 forms a first side of an external zipper chain disposed between the two flaps 102, 103 by means of a seam (not shown). Zipper tape 104 includes a row of teeth 105, a pin 106 at one end, and a stop 110 at the other end. Finished edges 107 are formed at the top portion 108 and bottom portion 109 of mounting sleeve 100. A loop portion 111 of hook-and-loop fastener is disposed at the edge of inner flap 102.

Figure 2:
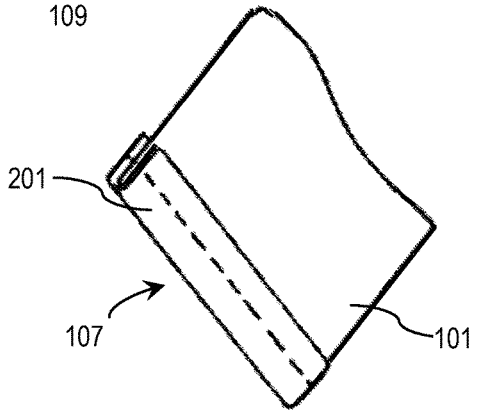
FIG. 2 shows an enlarged perspective view of a portion of an exemplary seam forming the finished edge of the fabric wrapper of the mounting sleeve of FIG. 1.

FIG. 2 shows that, in the embodiment of FIG. 1, finished edges 107 are constructed as bound seams, although other types of seams may be used in alternative embodiments. Each bound seam is formed by folding a vinyl binding strip 201 (or other strip, ribbon, braid, tape, or the like) over the edge of fabric wrapper 101 and using a single-needle stitch to reinforce and finish the edges.

Figure 3:
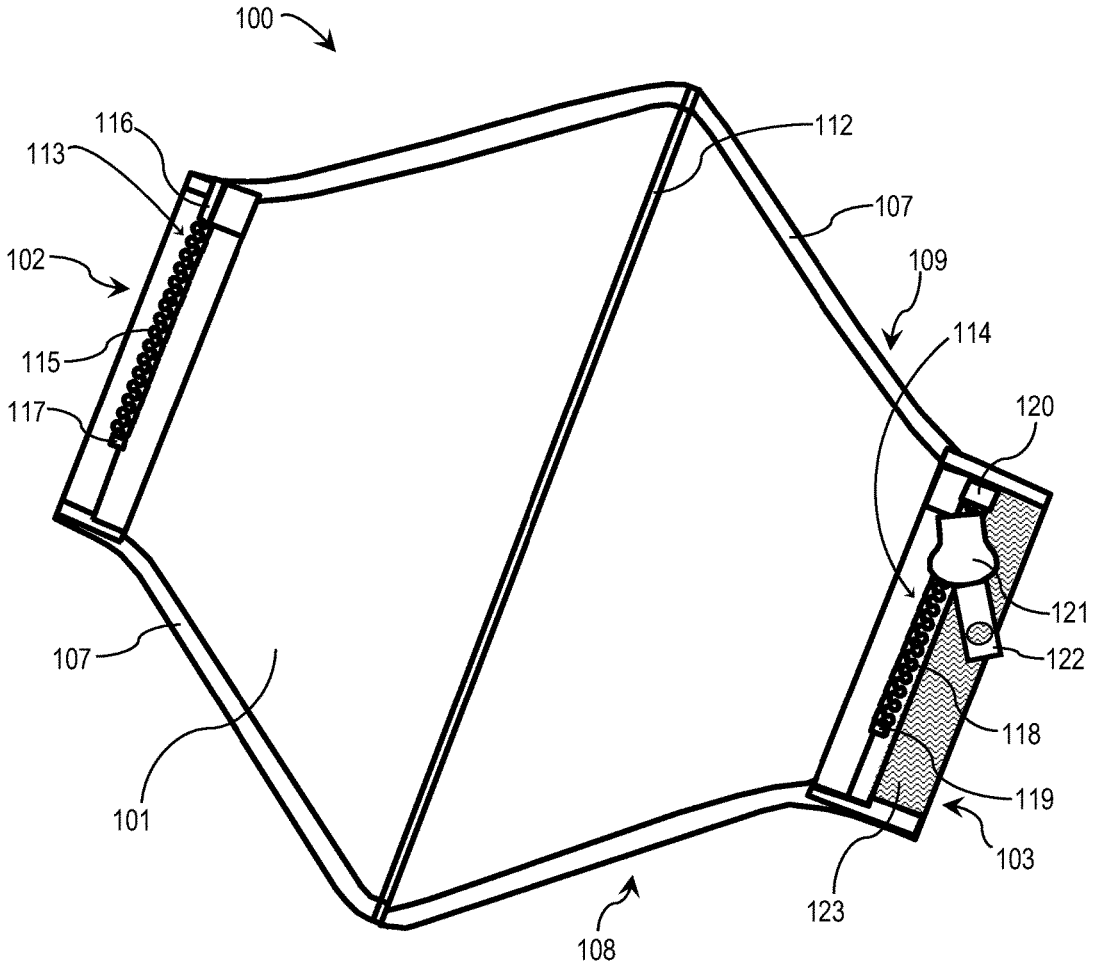
FIG. 3 shows a bottom plan view of the mounting sleeve of FIG. 1.

FIG. 3 shows a bottom plan view of mounting sleeve 100. It can be seen from this view that, for reinforcement, the edge of each of flaps 102, 103 is folded onto itself and sewn into place using a J-seam (not shown). It can also be seen that a centrally-disposed ridge 112 separating flaps 102, 103 is formed in and protrudes from fabric wrapper 101. Ridge 112 is folded around zipper tape 104 and sewn to zipper tape 104 (not shown) to secure zipper tape 104 to fabric wrapper 101.

A zipper tape 113 disposed at the edge of inner flap 102 forms a first side of an internal zipper chain, while another zipper tape 114 disposed at the edge of outer flap 103 forms a second side of the internal zipper chain. Zipper tape 113 includes a row of teeth 115, a pin 116 at one end, and a stop 117 at the other end. Zipper tape 114 includes a row of teeth 118, a stop 119 at one end, a pin box 120 at the other end, a slider 121 slidably disposed on teeth 118, and a puller 122 coupled to slider 121.

A hook portion 123 of hook-and-loop fastener is disposed at the edge of outer flap 103 and is adapted to releasably attach to loop portion 111, which is disposed at the edge of inner flap 102.

Figure 4:
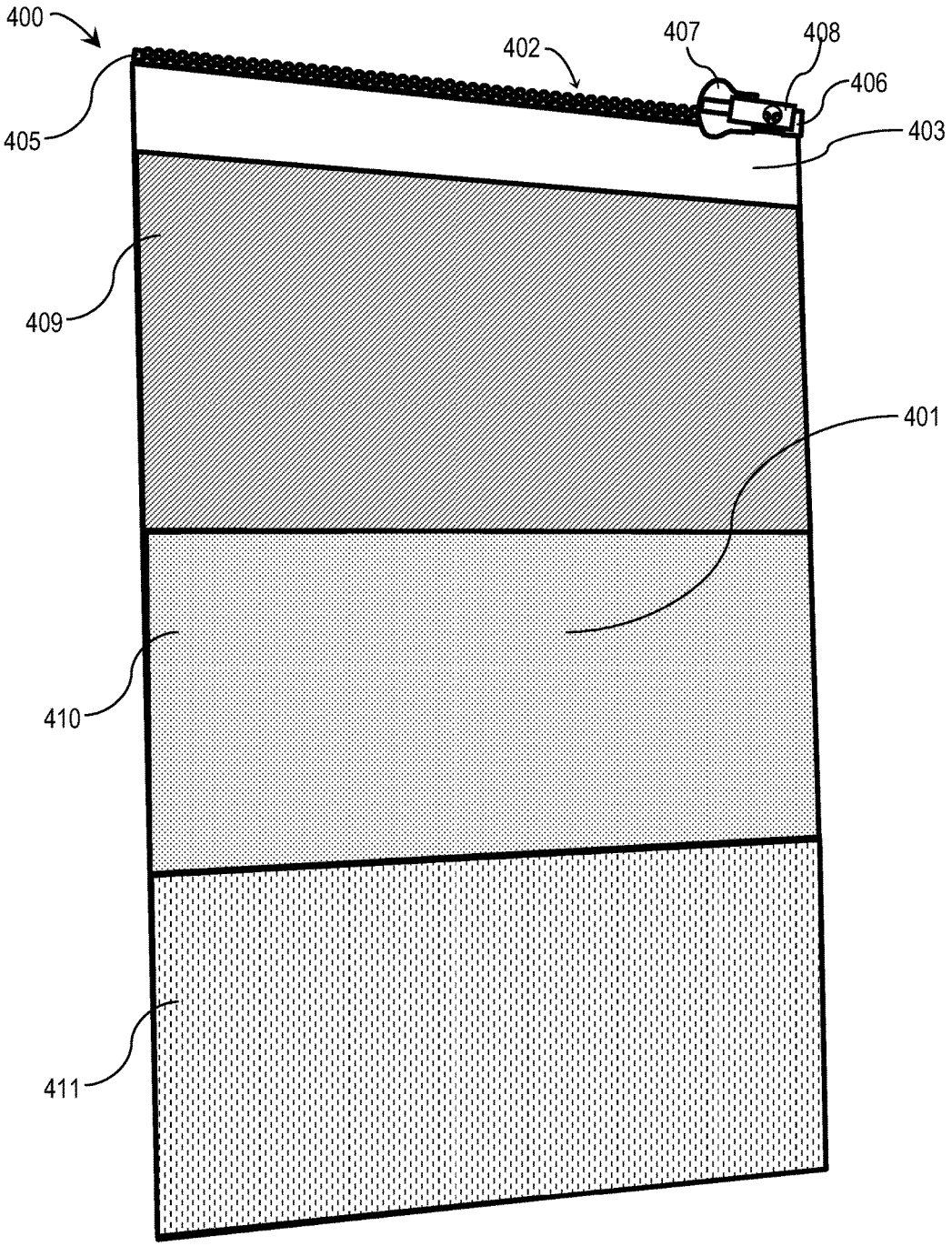
FIG. 4 shows a detachable flag adapted to securely fasten to the mounting sleeve of FIG. 1.

FIG. 4 shows an exemplary detachable flag 400 adapted to securely fasten to mounting sleeve 100. Flag 400 has an ornamental portion 401 that includes one or more panels of fabric bearing a flag or banner design, message, or the like. In this exemplary embodiment, ornamental portion 401 of flag 400 includes three differently-colored panels 409, 410, 411 that together form an Irish, French, or Italian national flag.

Flag 400 also includes a zipper tape 402 along one end, as well as a transition strip 403 (e.g., plain white or black) connecting ornamental portion 401 to zipper tape 402, e.g., by means of seams (not shown). Zipper tape 402 includes a row of teeth 404, a stop 405 at one end, a pin box 406 at the other end, a slider 407 slidably disposed on teeth 404, and a puller 408 coupled to slider 407. Zipper tape 402 forms a second side of the external zipper chain with zipper tape 104 disposed on mounting sleeve 100 and has approximately the same length as zipper tape 104. Ornamental portion 401 is desirably a durable nylon material, such as a 200 to 1000 denier nylon material having a UV-inhibitor coating and a flame-retardant finish, but may alternatively be constructed from polyester, another durable and weatherproof material, or the like. Transition strip 403 is desirably sized so that only a small portion of transition strip 403 is visible while flag 400 is attached to mounting sleeve 100.

With reference now to FIGS. 5-8, an exemplary installation method for attaching flag 400 onto a vehicle by means of mounting sleeve 100 will now be described.

Figure 5:
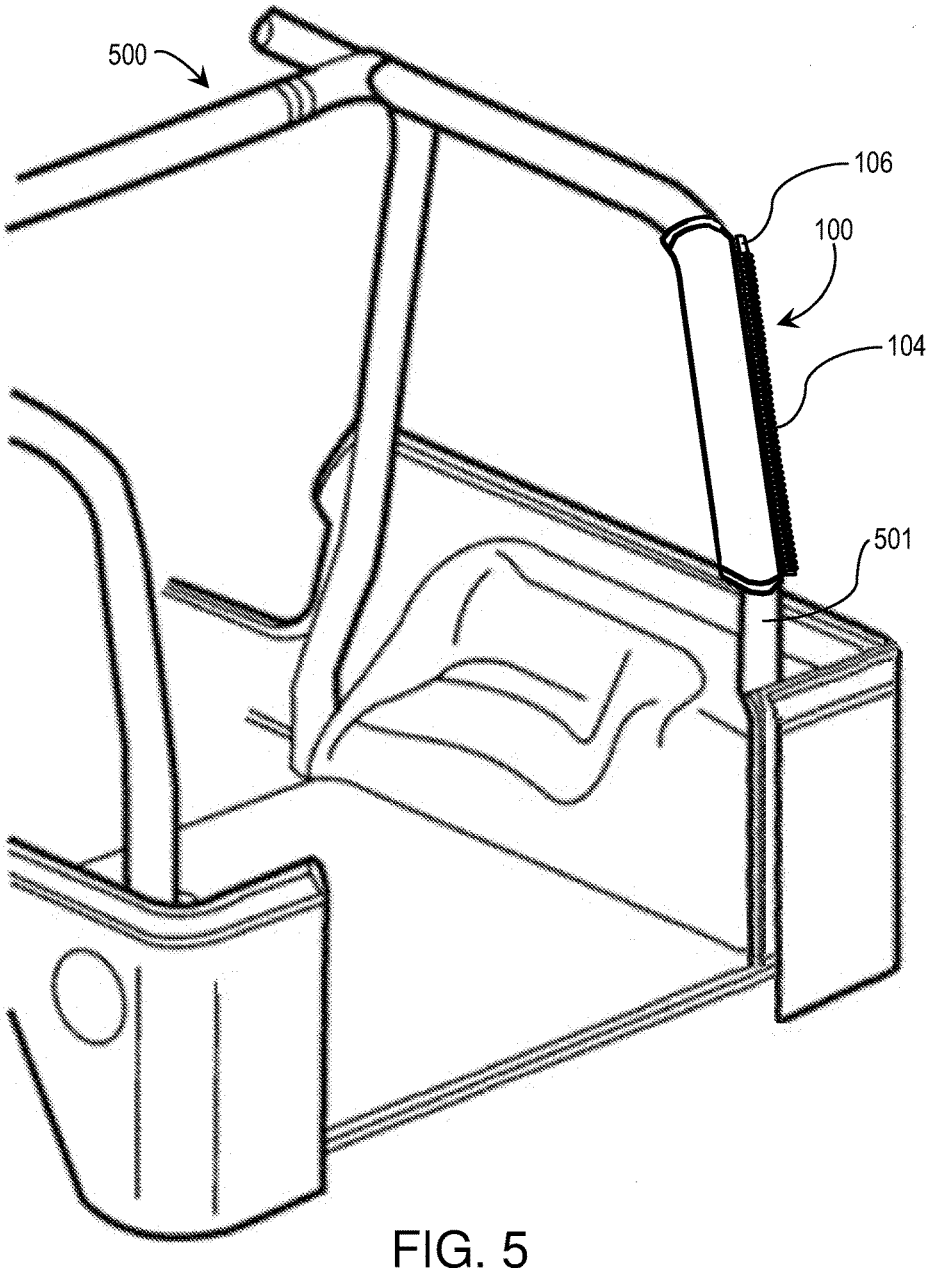
FIG. 5 shows the mounting sleeve of FIG. 1 installed onto the roll bar of a vehicle.

As shown in FIG. 5, an exemplary open-top off-road vehicle 500 has a roll cage structure that includes roll bar 501. First, mounting sleeve 100 is installed onto roll bar 501 by wrapping mounting sleeve 100 around roll bar 501. Second, slider 121 is engaged with pin 116, and then puller 122 is grasped to manipulate slider 121 along zipper tapes 113 and 114, so as to engage and mesh together zipper tape 113 and zipper tape 114 to form the internal zipper chain. Third, hook portion 123 of hook-and-loop fastener, which is disposed at the edge of outer flap 103, is pressed onto loop portion 111, which is disposed at the edge of inner flap 102. By firmly coupling loop portion 111 to hook portion 123, the internal zipper chain formed by zipper tape 113 and zipper tape 114 is completely covered, secured, and protected, while also snugly securing mounting sleeve 100 to roll bar 501. In this configuration, zipper tape 104 protrudes from mounting sleeve 100 along its length, and mounting sleeve 100 is oriented so that pin 106 is at the top of zipper tape 104.

Figure 6:
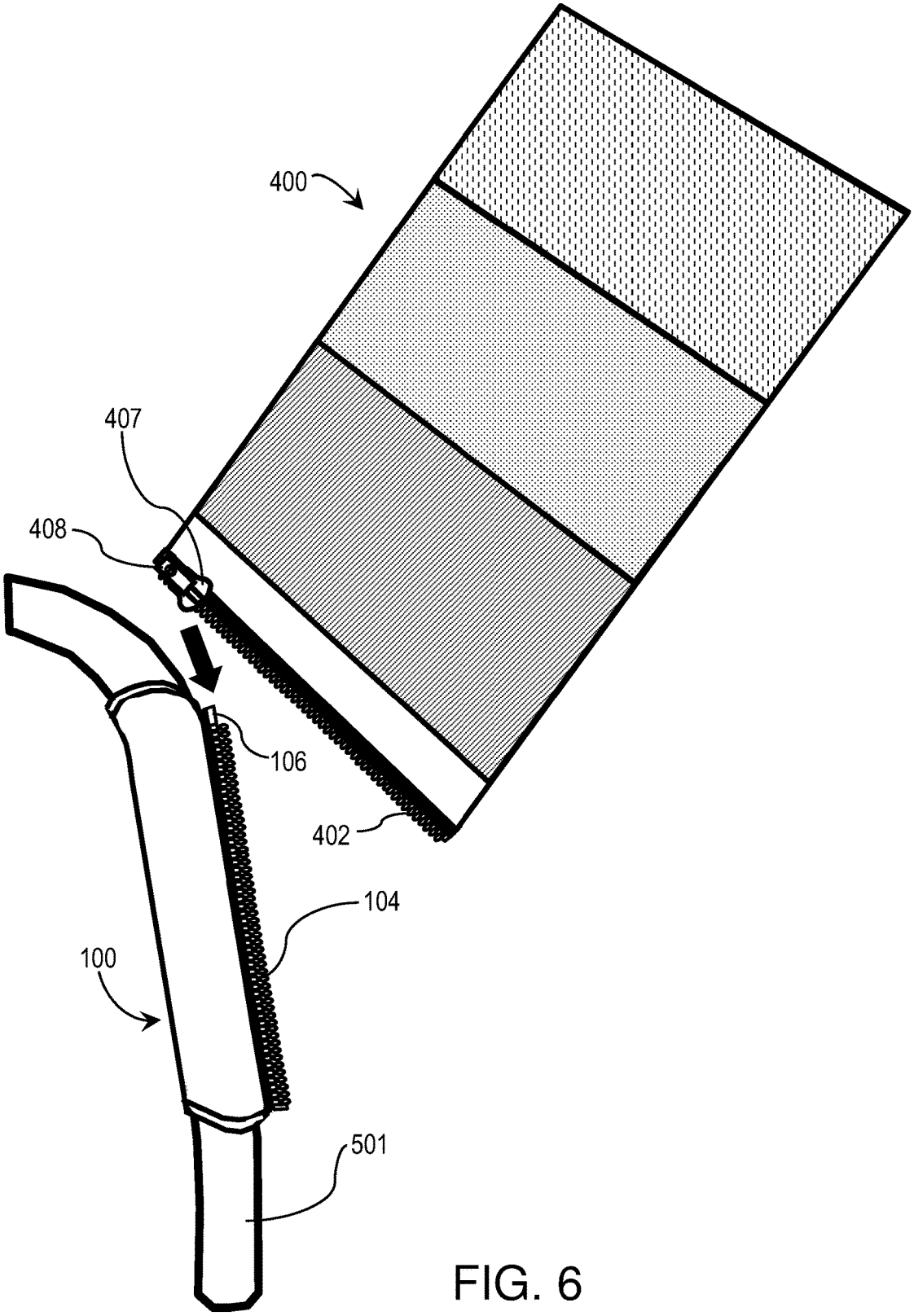
FIG. 6 shows an enlarged view of the vehicle roll bar of FIG. 5, with the mounting sleeve installed onto the roll bar and the detachable flag in position and ready to be securely fastened to the mounting sleeve.

Turning now to FIG. 6, it can be seen that flag 400 is fastened to mounting sleeve 100 by engaging slider 407 with pin 106, and then grasping puller 408 to manipulate slider 407 along zipper tapes 104 and 402, so as to engage and mesh together zipper tape 104 and zipper tape 402 to form the external zipper chain.

Figure 7:
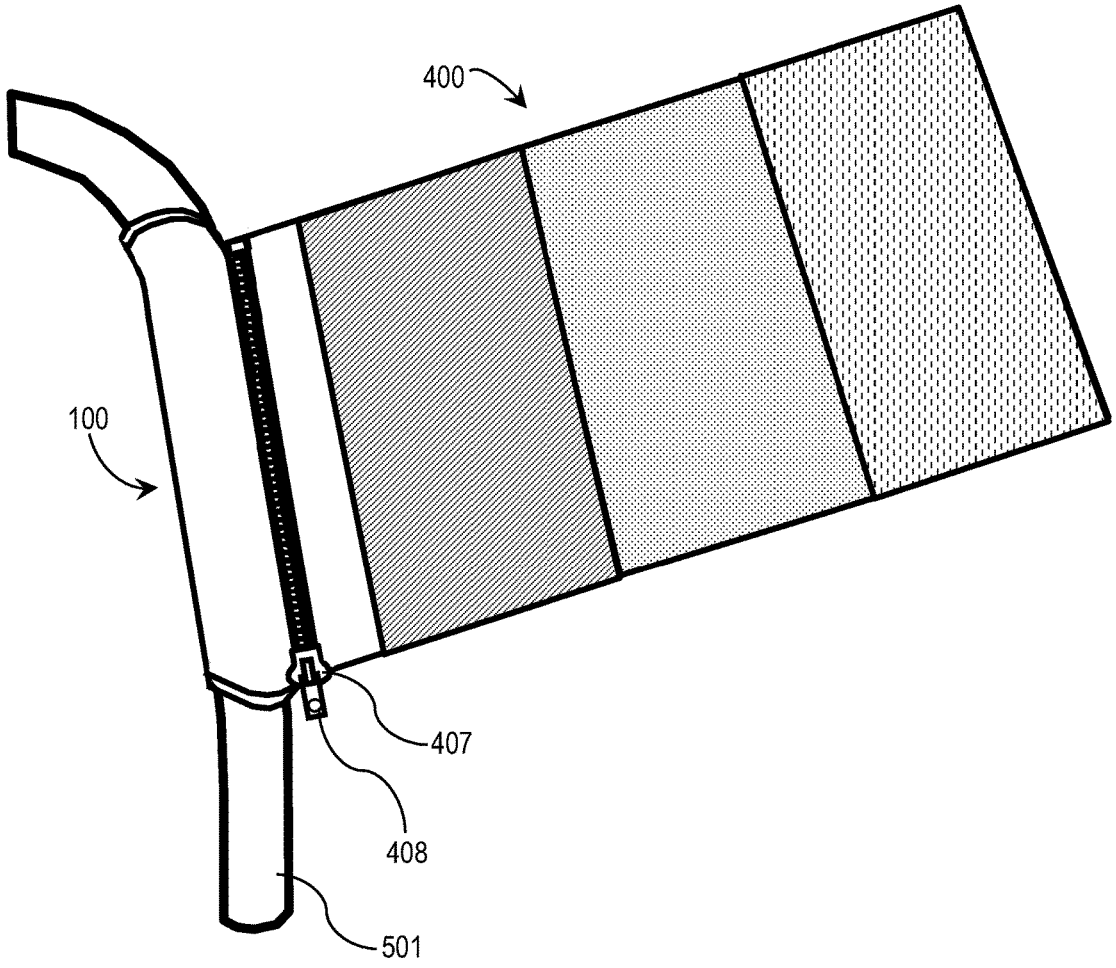
FIG. 7 shows an enlarged view of the vehicle roll bar of FIG. 5, with the mounting sleeve installed onto the roll bar and the detachable flag securely fastened to the mounting sleeve.

FIG. 7 shows flag 400 completely fastened to mounting sleeve 100. It is noted that zipper tapes 104 and 402 are oriented such that the zipping begins at the top of flag 400 and ends at the bottom of flag 400. In this manner, slider 407 and puller 408 rest at the bottom of flag 400 when flag 400 is fully attached to mounting sleeve 100, with gravitational forces assisting in preventing the external zipper chain from opening during travel of vehicle 500.

Figure 8:
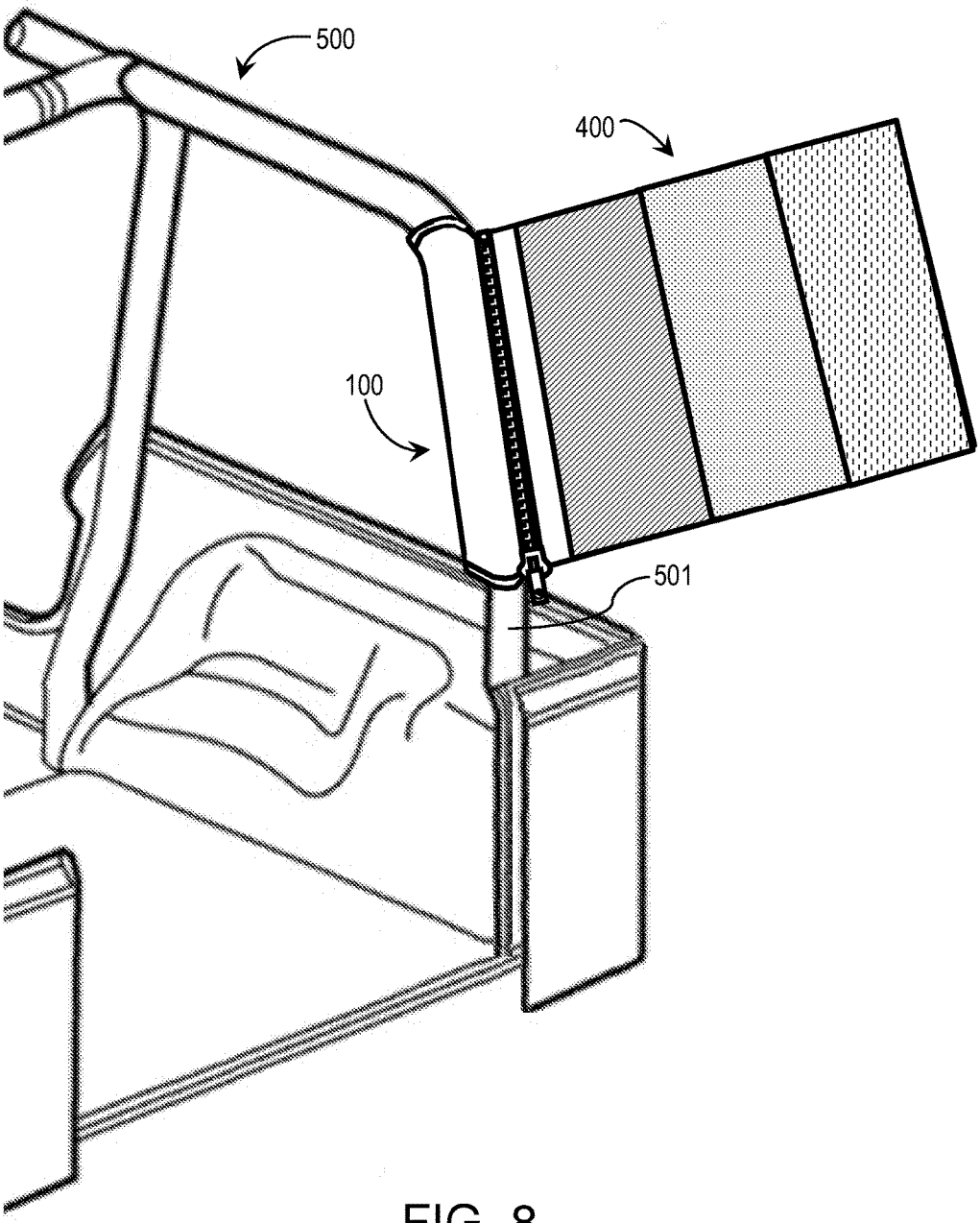
FIG. 8 shows the mounting sleeve of FIG. 1 installed on the roll bar, with the detachable flag securely fastened to the mounting sleeve.

FIG. 8 shows an overview of mounting sleeve 100 installed on roll bar 501 of open-top off-road vehicle 500, with flag 400 securely fastened to mounting sleeve 100.

Figure 9:
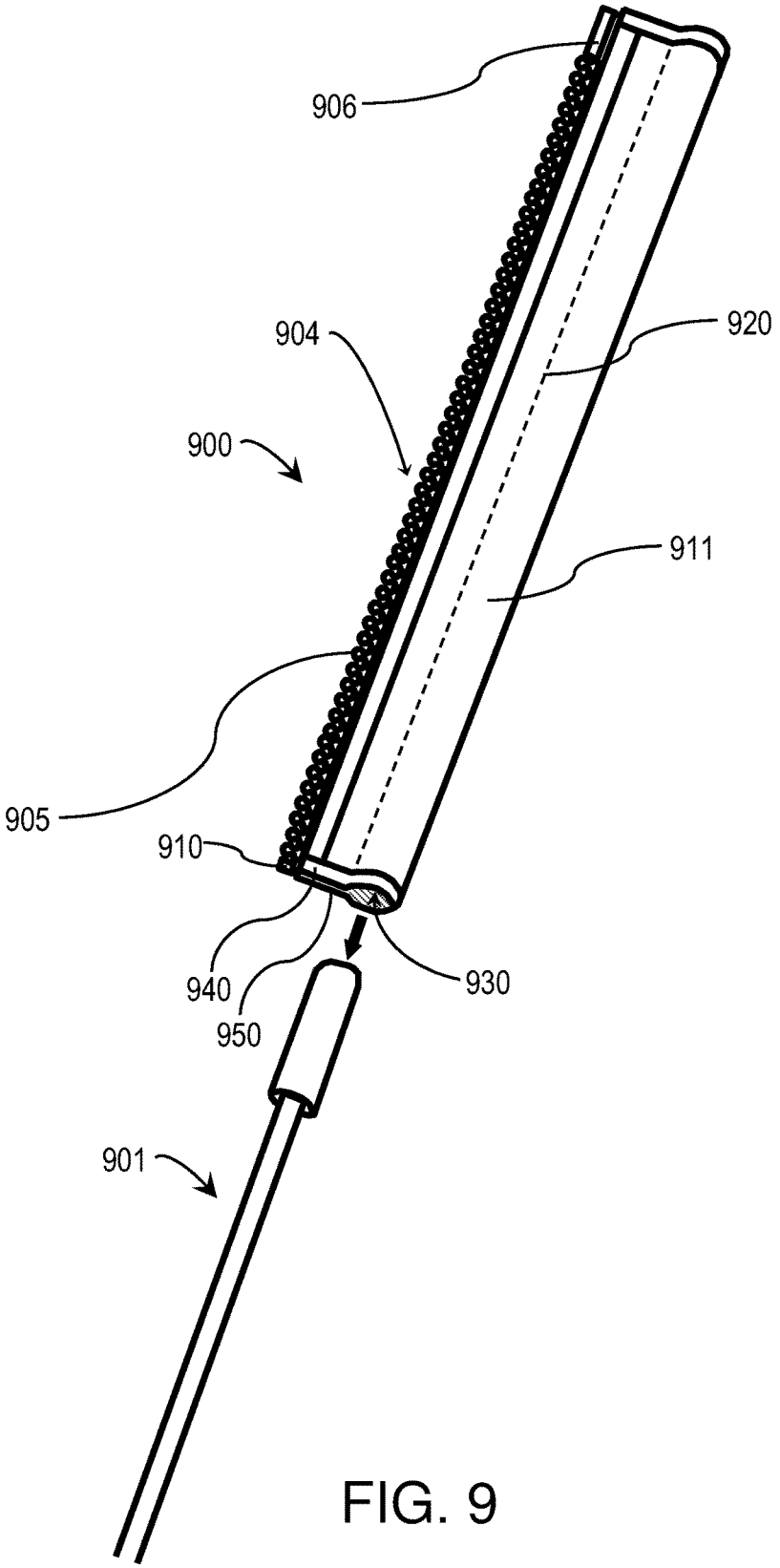
FIG. 9 shows a perspective view of a mounting sleeve consistent with a second exemplary embodiment of the disclosure, adapted for attachment to a vehicle antenna.

Turning now to FIG. 9, a mounting sleeve 900 consistent with a second exemplary embodiment of the disclosure is shown. Mounting sleeve 900 serves a similar function as mounting sleeve 100, except that mounting sleeve 900 is adapted for attachment to a vehicle antenna 901 by sliding mounting sleeve 900 over the end of antenna 901, instead of being secured with a zipper and hook-and-loop fastener. Although mounting sleeve 900 is approximately rectangular in shape, other mounting sleeve shapes are possible in alternative embodiments, including e.g., square, hexagonal, trapezoidal, octagonal, and semi-circular.

As shown, in this embodiment, mounting sleeve 900 includes a fabric wrapper 911 folded onto itself to form an upper layer 940 and a lower layer 950. Layers 940 and 950 are sewn together using a prayer seam along dashed line 920 so as to form an aperture 930 within mounting sleeve 900 suitable for receiving antenna 901. Fabric wrapper 911 is desirably an open-weave, military-grade, outdoor mesh fabric, and may include one or more of polyvinyl chloride (PVC) mesh, a vinyl-coated synthetic fiber (e.g., polyester) mesh having ultraviolet (UV) resistance, or the like.

A zipper tape 904 forms a first side of an external zipper chain disposed between upper layer 940 and lower layer 950 of fabric wrapper 911 by means of a seam (not shown). Zipper tape 904 includes a row of teeth 905, a pin 906 at one end, and a stop 910 at the other end.

Mounting sleeve 900 is installed onto antenna 901 by inserting the end of antenna 901 into one end of aperture 930 and then sliding mounting sleeve 900 onto antenna 901 until the end of antenna 901 emerges from the other end of aperture 930. Aperture 930 is desirably sized to create a friction fit with antenna 901 that permits mounting sleeve 900 to remain in place snugly at a desired location along the length of antenna 901. In this configuration, zipper tape 904 protrudes from mounting sleeve 900 along its length, and mounting sleeve is oriented so that pin 906 is at the top of zipper tape 904.

The process for fastening flag 400 to mounting sleeve 900 proceeds in like manner to that by which flag 400 is fastened to mounting sleeve 100. First, slider 407 is engaged with pin 906, and then puller 408 is grasped to manipulate slider 407 along zipper tapes 904 and 402, so as to engage and mesh together zipper tape 904 and zipper tape 402 to form the external zipper chain.

Figure 10:
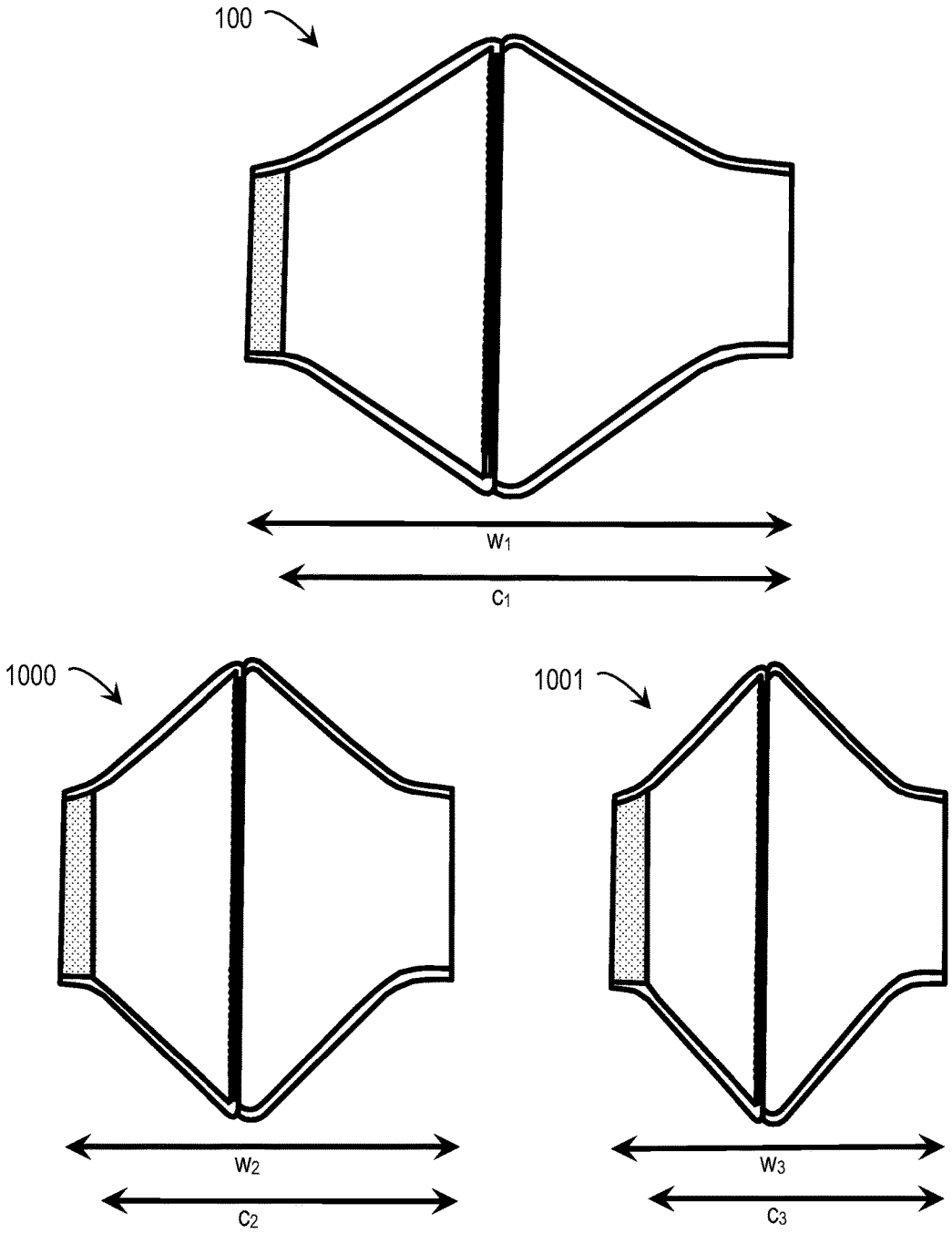
FIG. 10 shows differently-sized mounting sleeves consistent with further exemplary embodiments of the disclosure.

FIG. 10 shows differently-sized mounting sleeves consistent with further exemplary embodiments of the disclosure. Since roll bars and other features (e.g., railings, posts, beams, or the like) used for attachment have different circumferences, various sizes of mounting sleeves that form apertures of different circumferences may be used. As shown, mounting sleeve 100 is a larger mounting sleeve that has a width of $w_1$ so as to form an aperture having a first circumference $c_1$ when mounting sleeve 100 is installed. Also shown is mounting sleeve 1000, which is a medium-sized mounting sleeve that has a width of $w_2$ so as to form an aperture having a second circumference $c_2$ smaller than the first circumference $c_1$ when mounting sleeve 100 is installed. Mounting sleeve 1001 is a small-sized mounting sleeve that has a width of $w_3$ so as to form an aperture having a third circumference $c_3$ smaller than each of the first two circumferences $c_1$, $c_2$ when mounting sleeve 100 is installed. Mounting sleeves 100, 1000, and 1001, as well as mounting sleeve 900, all employ the same zipper configuration to permit interchangeability of a single flag 400, or a variety of flags with different mounting sleeves.

In alternative embodiments, a single variably-sized mounting sleeve may be used, such as a mounting sleeve without an internal zipper chain and having a larger loop portion of hook-and-loop fastener that permits releasable attachment of the hook portion at various locations to provide an adjustable circumference.

FIGS. 11-16 illustrate exemplary process steps for constructing a mounting sleeve, such as mounting sleeve 100, in one embodiment of the disclosure.

Figure 11:
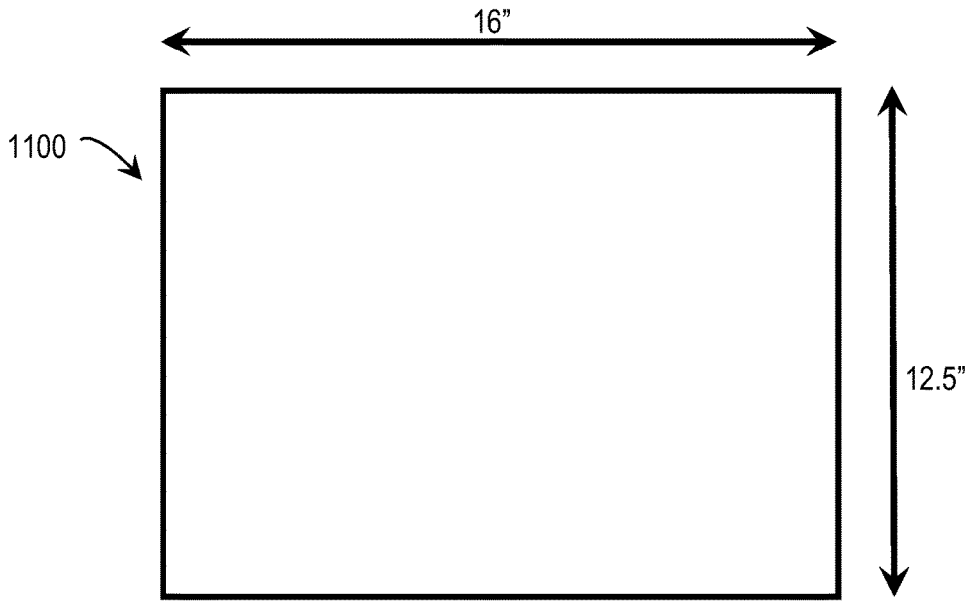
FIGS. 11-16 illustrate exemplary process steps for constructing the mounting sleeve of FIG. 1, in one embodiment of the disclosure.

FIG. 11 shows that, in this embodiment, construction begins with a rectangular section 1100 of fabric wrapper having dimensions of 12.5 inches by 16 inches.

Figure 12:
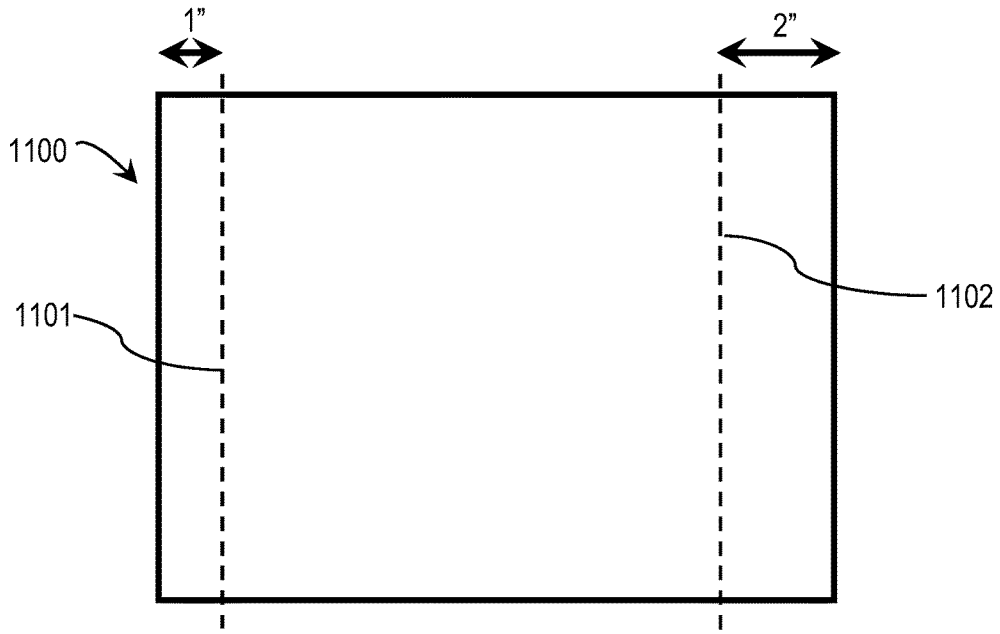

Next, as shown in FIG. 12, an inward fold is made along line 1101, one inch from the left edge of section 1100, and an inward fold is made along line 1102, two inches from the right edge of section 1100. These folds 1101, 1102 are made to provide support for the portions of hook-and-loop fastener and to create finished edges. After folding, the width of the section 1100 of material is reduced from 16 inches to 13 inches, and the folded edges are stitched. Vinyl binding strips (not shown) are then added to the top and bottom edges of the section 1100 of material to finish the edges.

Figure 13:
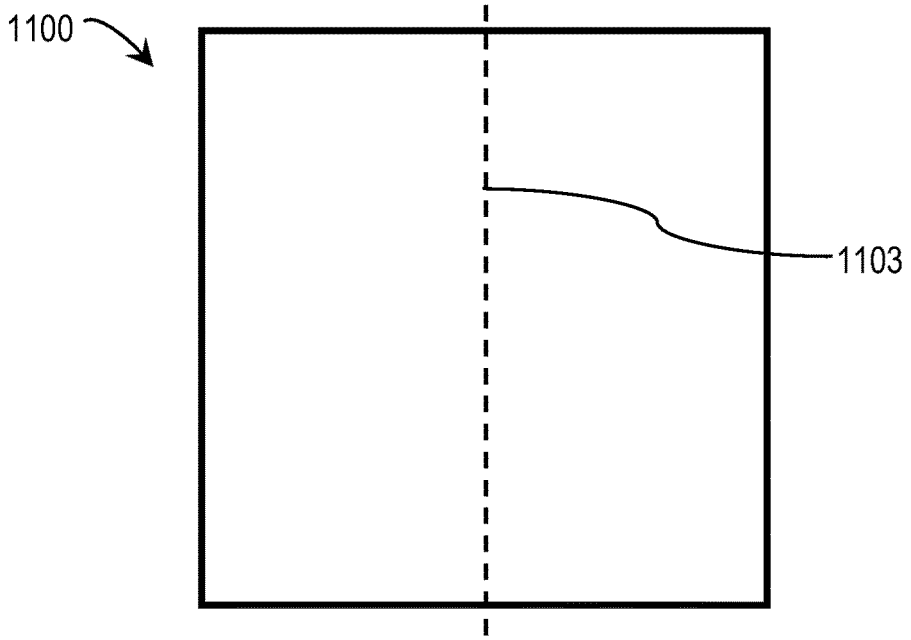

As FIG. 13 shows, the section 1100 of material is then folded in half centrally, along line 1103.

Figure 14:
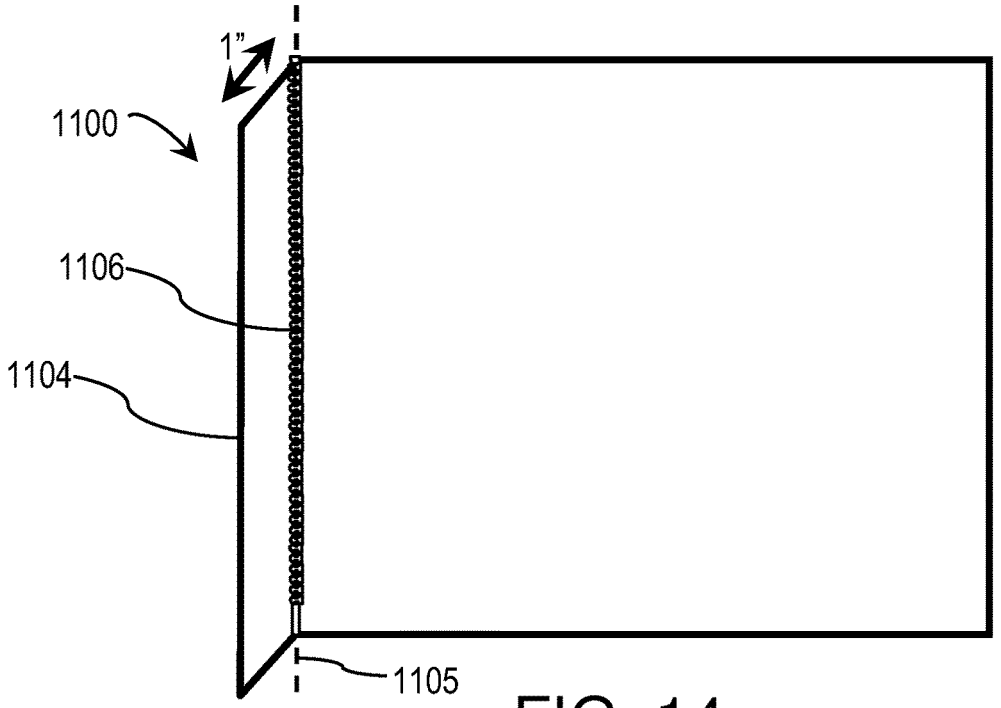

Next, as shown in FIG. 14, the folded middle edge 1104 is then folded inward by one inch along line 1105. A 12-inch length of zipper tape 1106, i.e., one side of the external zipper chain, is then placed along line 1105, one inch from the folded middle edge 1104 of the section 1100 of material. The section of material is folded over along line 1105, and the folded edge is stitched, with zipper tape 1106 stitched into the fold facing outwards.

Figure 15:
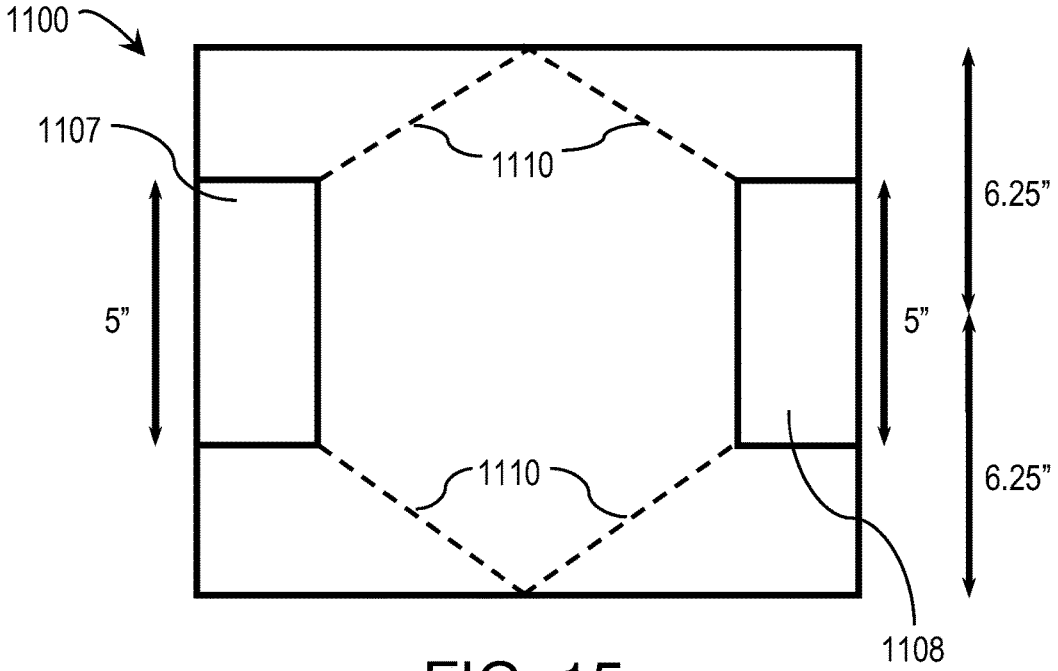

Next, as shown in FIG. 15, after attachment of zipper tape 1105, the section 1100 of material is re-opened and is laid flat. The loop portion 1107 (on one side of section 1100) and the hook portion 1108 (on the opposite side of section 1100) of hook-and-loop fastener are then placed and stitched (although placement and stitching of portions 1107, 1108 could alternatively take place subsequently). The width of loop portion 1107 and hook portion 1108 is 5 inches, and the center of each portion 1107, 1108 is disposed 6.25 inches from the top and bottom edges of section 1100. Section 1100 is then cut along dashed lines 1110 and around portions 1107, 1108 to create a tapered shape for the mounting sleeve.

Figure 16:
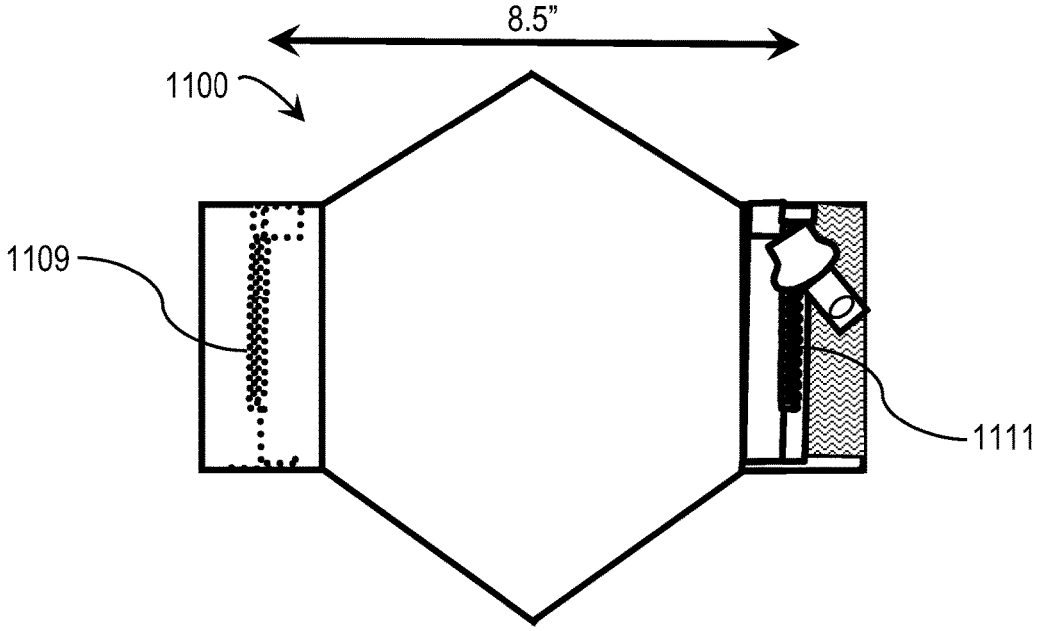

FIG. 16 shows the final step of placement and stitching of zipper tapes 1109 and 1111, which form the internal zipper chain. Zipper tape 1109 (on one side of section 1100) and zipper tape 1111 (on the opposite side of section 1100) are spaced 8.5 inches apart. Once zipper tape 1109, 111 has been stitched, the fabrication of mounting sleeve 100 is complete.

In the embodiments shown, the mounting sleeve and flag have particular sizes, shapes, dimensions, and other visual characteristics. However, it should be understood that a flag system consistent with embodiments of the disclosure can alternatively be made to have various other sizes, shapes, dimensions, and visual characteristics.

Although embodiments of the disclosure are described as being used in connection with motor vehicles and the like, it should be understood that a flag system consistent with embodiments of the disclosure may alternatively be attached to other items that are elongated or cylindrical, whether mounted vertically, horizontally, or in other orientations. Embodiments of the present disclosure may be used with automobiles, motorcycles, boats, recreational vehicles, snowmobiles, all-terrain vehicles, and other vehicles, as well as non-vehicle and/or stationary elements on which it is desirable to display a flag, a banner, or both.

The term "rod," as used herein, should be construed to include a bar, a roll bar, a roll cage element, an antenna, a rail, a pole, a post, a stick, a staff, and any structural member of a vehicle or stationary element around which a mounting element, as described herein, may be wrapped, slid, or otherwise disposed, to serve as a base for a detachable flag, as described herein. Although the term "rod" suggests an elongated member, in certain embodiments, the rod is not necessarily elongated but is appropriately dimensioned so as to permit a mounting element to be wrapped around or slid onto the rod and secured to the rod.

The zipper components described herein may be, e.g., heavy-duty plastic No. 10 zippers, as well as metal zippers and zippers of other sizes and types. Although embodiments are described herein as employing both hook-and-loop fastener and zippers to secure a mounting sleeve around a rod, other fastening devices are possible in alternative embodiments, including, e.g., one or more of: a buckle, a button, a clip, a catch, a clasp, a latch, a lock, a hook, a loop, an eye, an aperture, a carabineer, a tie, an elastic or non-elastic strap, or a snap. Some alternative embodiments employ only a zipper, and other alternative embodiments employ only hook-and-loop fastener as fastening devices. Certain alternative embodiments employ a zipper that is covered only partially by hook-and-loop fastener. Accordingly, the term "fastening devices" should be construed as including one or more of the foregoing, as well as other fastening devices not specifically mentioned herein.

Fastening devices other than a zipper, including one or more of the foregoing, may be used, in alternative embodiments, to fasten a flag to a mounting sleeve. In some embodiments, a zipper may be used in conjunction with other fastening devices for this purpose. In other embodiments, a fastening device may be disposed only on the mounting sleeve, or only on the flag. For example, in one alternative embodiment, clips disposed on the mounting sleeve are used to fasten a flag that includes no fastening devices. In another alternative embodiment, clips disposed on the flag are used to fasten the flag to a mounting sleeve that includes no fastening devices.

It should be understood that the locations and types of seams shown and described herein are merely exemplary, and that other locations and types of seams may be used in alternative embodiments.

It should be understood that various changes in the details, materials, and arrangements of the parts which have been described and illustrated in order to explain the nature of this disclosure may be made by those skilled in the art without departing from the scope of the disclosure.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments.

Although the disclosure has been described using relative terms such as "front," "back," "side," "top," "bottom," "over," "above," "under" and the like in the description and in the claims, such terms are used for descriptive purposes and not necessarily for describing permanent relative positions. It is understood that the terms so used are interchangeable under appropriate circumstances such that the embodiments of the disclosure described herein are, for example, capable of operation in other orientations than those illustrated or otherwise described herein. Notwithstanding the foregoing, the terms "top" and "bottom," when describing a flag herein, specifically refer to the top portion and bottom portion of the flag, respectively, when the flag is observed in its normal, typical, and/or correct visual orientation.

Although the disclosure is described herein with reference to specific embodiments, various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the disclosure.

Although the disclosure has been set forth in terms of the exemplary embodiments described herein and illustrated in the attached drawings, it is to be understood that such disclosure is purely illustrative and is not to be interpreted as limiting. Consequently, various alterations, modifications, and/or alternative embodiments and applications may be suggested to those skilled in the art after having read this disclosure. Accordingly, it is intended that the disclosure be interpreted as encompassing all alterations, modifications, or alternative embodiments and applications as fall within the true spirit and scope of this disclosure.

It will be further understood that various changes in the details, materials, and arrangements of the parts which have been described and illustrated in order to explain the nature of this disclosure may be made by those skilled in the art without departing from the scope of the disclosure as expressed in the following claims.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

I claim:

1. A flexible mounting sleeve comprising:

a fabric wrapper having a first section, a second section, and an intermediate section located between the first and second sections, wherein:

the fabric wrapper is folded unto itself;

the first section is sewn to the second section forming an aperture of the intermediate section;

the first section has substantially the same dimensions as the second section;

the flexible mounting sleeve is adapted to slide onto a rod; and the aperture is sized so as to attach around the rod by friction fit; and a fastening device for releasably fastening a flag to the mounting sleeve.

2. The sleeve of claim 1, wherein:

the first and second sections have a section width;

the aperture has a diameter; and the section width is less than twice the aperture diameter.

3. The sleeve of claim 1, wherein the fastening device is sewn to the first and second sections.

4. The sleeve of claim 1, wherein the fastening device is sufficiently close to the aperture such that when the mounting sleeve is attached around the rod, the rod provides rigid support to the fastening device.

5. The sleeve of claim 4, where the rigid support facilitates the fastening and unfastening of the flag.

6. The sleeve of claim 1, wherein:

the flexible mounting sleeve has a height;

the fastening device is a fixed distance from the aperture; and the fixed distance from the fastening device to the aperture is less than ⅛ of the flexible-mounting-sleeve height.

7. The sleeve of claim 1, wherein the rod is an antenna.

8. A flexible mounting sleeve comprising:

a fabric wrapper having a first section, a second section, and an intermediate section located between the first and second sections, wherein:

the fabric wrapper is folded unto itself;

the first section is sewn to the second section forming an aperture of the intermediate section;

the flexible mounting sleeve is adapted to slide onto a rod; and the aperture is sized so as to attach around the rod by friction fit; and a fastening device for releasably fastening a flag to the mounting sleeve, wherein:

the flexible mounting sleeve has a height;

the fastening device is a fixed distance from the aperture; and the fixed distance from the fastening device to the aperture is less than ⅛ of the flexible-mounting-sleeve height.

9. The sleeve of claim 8, wherein the fastening device is sewn to the first and second sections.

10. The sleeve of claim 8, wherein the fastening device is sufficiently close to the aperture such that when the mounting sleeve is attached around the rod, the rod provides rigid support to the fastening device.

11. The sleeve of claim 10, where the rigid support facilitates the fastening and unfastening of the flag.

12. The sleeve of claim 8, wherein the rod is an antenna.

* * * * *